US007931443B1

(12) United States Patent
Potter et al.

(10) Patent No.: US 7,931,443 B1
(45) Date of Patent: Apr. 26, 2011

(54) HIGH TWIST COMPOSITE BLADE

(75) Inventors: Brian Potter, Palm Beach Gardens, FL (US); Alfred P. Matheny, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 922 days.

(21) Appl. No.: 11/827,055

(22) Filed: Jul. 10, 2007

(51) Int. Cl.
*F01D 5/26* (2006.01)

(52) U.S. Cl. ..... 416/224; 416/232; 416/240; 416/241 R; 416/500

(58) Field of Classification Search ..... 416/230, 416/232, 224, 240, 241 R, 241 A, 500, 66, 416/81
See application file for complete search history.

(56) References Cited

U.S. PATENT DOCUMENTS 3,795,462 A 3/1974 Trumpler, Jr.
4,108,572 A * 8/1978 Platt ..... 416/230
4,334,824 A 6/1982 Tsuchikawa et al.
5,083,371 A * 1/1992 Leibfried et al. ..... 29/889.72
5,279,892 A * 1/1994 Baldwin et al. ..... 442/206
5,509,781 A * 4/1996 Boszor et al. ..... 415/200
5,896,658 A * 4/1999 Calle et al. ..... 29/889.72
6,669,447 B2 12/2003 Norris et al.
7,070,390 B2 7/2006 Powell
7,311,500 B2 * 12/2007 Rongong et al. ..... 416/230
2005/0047918 A1 * 3/2005 Powell ..... 416/233
* cited by examiner

*Primary Examiner* — Igor Kershteyn
(74) *Attorney, Agent, or Firm* — John Ryznic

(57) ABSTRACT

A turbomachine with a row of blades in which the blades are structured such that the blades can untwist at higher rotational speeds in order to provide optimal aerodynamics at different rotational speeds. Each blade is formed with a thin slot between the pressure side wall and the suction side wall so that stresses from centrifugal forces occurring during high rotations will not pass from adjacent walls and allow for the blade to untwist more than a solid blade. Each blade is formed from a fiber laminated composite material with the fibers oriented at different directions to form different stiffness in each direction so that a desired untwist can occur based upon a given blade mass and rotational speed. A thin sheet of a slippery material can be placed within the thin slot and between the adjacent airfoil walls to allow slippage between the adjacent walls and to promote damping for the blade.

16 Claims, 1 Drawing Sheet

HIGH TWIST COMPOSITE BLADE

CROSS-REFERENCE TO RELATED APPLICATIONS

None.

BACKGROUND OF THE INVENTION

1. Field of the Invention

The present invention relates to turbomachinery blades, and more specifically to axial flow blades with untwisting capability.

2. Description of the Related Art Including Information Disclosed Under 37 CFR 1.97 and 1.98

Axial flow turbomachinery blades, such as those used in a compressor, operate at high rotational speeds. The blades extend from a rotor toward a blade tip. In order to improve a flow performance of the turbomachine, the blades are designed with a certain amount of twist in the airfoil cross section. The amount of twist in the airfoil near the rotor is less than is the amount of twist in the airfoil near the tip. This is due to the higher circumferential rotational speed of the blade tip. Because the blades do not untwist during high rotation speeds, variable inlet guide vanes are used in a turbomachine like a gas turbine engine compressor to direct the air flow into the compressor blades.

As the turbomachine increases in rotational speed, the blade tends to untwist due to the imposition of centrifugal force on the blade. A blade is designed so that the blade will untwist at a certain rotational speed and at a certain amount (of untwist). The turbomachine is therefore designed to operate at a high efficiency only at that certain design speed. Rotors operating at a higher rotational speed will untwist further and result in lower performance. U.S. Pat. No. 4,334,824 issued to Tsuchikawa et al on Jun. 15, 1982 and entitled FLEXIBLE FAN DEVICE shows a flexible fan device in which the blades twist due to centrifugal force due to increase speed of rotation. The blades are solid and the fan is a relatively low speed fan used in an automobile engine. Because of this, the blades can be made from a thin material. This design would not work in a high speed turbomachine such as an axial flow compressor because the blades would have to be of such thickness (for structural rigidity) that untwisting would not be enough to increase the performance. U.S. Pat. No. 3,795,462 issued to Trumpler, Jr. on Mar. 5, 1974 and entitled VIBRATION DAMPENING FOR LONG TWISTED TURBINE BLADES shows a row of steam turbine blades with solid blades that can untwist due to high centrifugal forces. However, a steam turbine still operates at relatively low speeds compared to a turbomachine such as a compressor.

U.S. Pat. No. 6,669,447 B2 issued to Norris et al on Dec. 30, 2003 and entitled TURBOMACHINE BLADE discloses a gas turbine engine fan blade with a hollow interior of the airfoil portion being at least partially filled with a vibration damping material bonded to at least one internal surface. The damping material is a viscoelastic material. In the Norris et al patent, the blade is made of a metal material and thus would not provide the amount of untwisting as would the composite blade of the present invention. The hollow metal blade of Norris will untwist slightly more than a solid metal blade, but not enough to provide a high efficient blade as in the present invention.

U.S. Pat. No. 7,070,390 B2 issued to Powell on Jul. 4, 2006 and entitled COMPONENT WITH INTERNAL DAMPING discloses a turbine blade used in a gas turbine engine in which a hollow airfoil is formed by bonding a pressure side wall to a suction side wall with a thin internal panel disposed in a cavity formed between the two walls. The internal panel is secured in the root portion between the two walls and extends freely up into the cavity with the tip end free floating. The cavity is filled with a visco-elastic damping material. The blade of Powell will untwist from the centrifugal forces due to high speed rotation. However, the untwist will not be enough to increase the performance level of the blades in the high range of operating speeds in which the present invention is designed for.

It is therefore an object of the present invention to provide for a turbomachine with blades that untwist to its optimal aerodynamic level at different rotational speeds.

It is another object of the present invention to provide for a compressor in which inlet guide vanes are not needed.

BRIEF SUMMARY OF THE INVENTION

The present invention is a composite blade used in an axial flow turbomachine in which the blade is designed to have a variable rate of untwist as the rotational speed of the rotor increases. The blade is formed with a thin slot between a pressure side and a suction side of the airfoil to allow for relative sliding between the two sides of the airfoil. The two airfoil walls that form the blade are made from a composite fibrous laminated material to provide different stiffness levels in each direction in order to design the blade stiffness and produce the desired amount of untwisting for a higher range of operating speeds than the cited prior art blades. The thin slot can be filled with one or more thin layers of a material such as Teflon or Kapton that will promote sliding and also act as a blade damper. The thin layer will allow for no shear between airfoil sides, therefore allowing for a larger range of twist in the airfoil.

DETAILED DESCRIPTION OF THE INVENTION

The present invention is an axial flow turbomachine in which a plurality of axial flow blades extends from a rotor to form the fan or pump of the axial flow turbomachine. Each blade of the turbomachine has a pressure side and a suction side. The blade is typically thin and slightly curved such that the pressure side is also considered to be the concave side, and the suction side is considered to be the convex side.

The blade 12 of the present invention is not a solid piece. But, includes a thin slot formed between the two blade halves. The thin slot occupies most of the surface area of the blade, extending to the tip and to the leading and trailing edges of the blade. Where the thin slot ends in where the two sides of the blade are joined to form a single piece. The thin slot allows for relative sliding to occur between the two sides of the blade during rotation of the rotor. The blade is designed with a certain twist therein for the purpose of increasing the efficiency of the turbomachine. As the rotational speed of the rotor increases, the blade will have the tendency to untwist due to the centrifugal force acting on the blade. A Prior Art blade made of a solid single piece will twist less under the same conditions as the present invention. Because the slot allows for no shear to exist between the two layers, the blade will tend to untwist more than the Prior Art blade. Because of the thin slot, the blade of the present invention can be designed to have a range of twist depending upon the rotational speed of the rotor. The amount of blade twist can then be designed to be at a certain angle at certain rotational speeds. Because of this, variable inlet guide vanes are not needed at the upstream end of the rotor to guide the air into the blades. If the inside surfaces of the two halves of the blade make contact during operation, the rubbing between the two halves can provide frictional damping for the blade. The slotted blade of the present invention provide for a variable twist as a function of rotational speed of the rotor.

Figure 1:
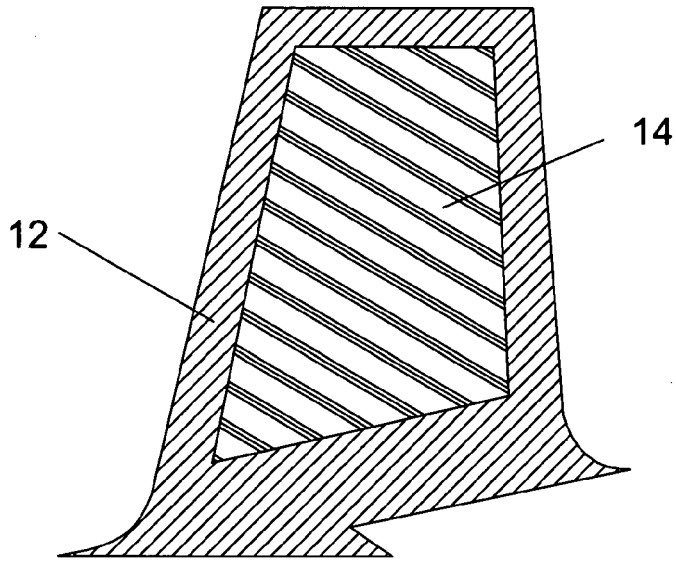
FIG. 1 shows a cutaway view of the airfoil of the present invention.
Figure 2:
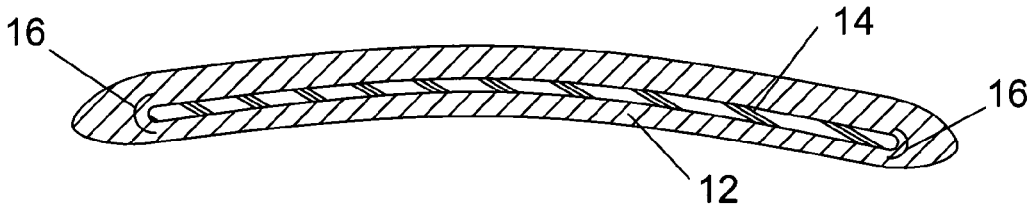
FIG. 2 shows a cross section view of the airfoil of FIG. 1.
Figure 3:
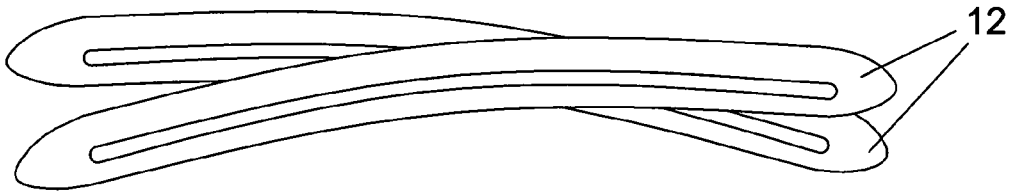
FIG. 3 shows a top view along a blade of the present invention with an amount of untwist displayed.

The blade of the present invention can be made from a metal material in which the two sides that form the airfoil are bonded together such that a thin slot is formed between the pressure side wall and the suction side wall to allow for the blade to untwist. The slot would be of such width between the two walls that no space is formed and the two walls actual rub against one another. The edges of the blade, such as the leading and trailing edge and the tip and platform sides, could be bonded together to form the blade. The bonding would only be performed along the contact surfaces so that the area represented by 14 in FIG. 1 would not be bonded but would be free to slide. Stress is not transferred from one side wall of the blade to the other or opposite side wall in order to allow for the large amount of untwist from the higher rotational speeds in the present invention such that the inlet guide vanes can be eliminated and the blades would operate at high efficiency through a large range of rotational speeds. The slot extends substantially from the leading edge region to the trailing edge region of the blade, and from the tip region to the platform region.

The metal blade of the present invention could also be made by forming a hollow blade with a large cavity between the pressure and suction side walls, and then compressing the two walls together to form the final airfoil shape with a concave pressure side and a convex suction side and with no space formed between the two walls but the two walls are not bonded together. Stress from one wall to the opposite wall does not pass from wall to wall so that the amount of blade untwist is high.

The blade, in the preferred embodiment, is made from a one or more plies of a composite fibrous laminated material with different stiffness in each ply such that the overall blade stiffness can be modified by changing the angles of the plies. The amount of blade untwist can therefore be accurately controlled based upon the blade mass and the rotational speed. For example, a composite blade would have the fiber angles set to untwist to the optimal aerodynamic configuration at different rotational speeds. The blade could have an amount of untwist of 1 degree at 4,000 rpm to eliminate the need for a variable inlet guide vane, and have an amount of untwist of 2 degrees at 8,000 rpm.

In an additional embodiment of the present invention, the thin slot 14 can be filled with one or more thin layers of a slippery material such as Teflon or Kapton. The layer of Teflon will allow for sliding between the two blade halves, and act as a damper for the blade. The presence of a thin slippery material in the slot between the two walls of the airfoil would provide damping for the blade. However, damping would also occur between the two walls from rubbing due to twisting.

In another embodiment, the thin layer includes a small resin bead 16 on the ends of the layer or layers. The small resin bead is used for the purpose of preventing crack growth in the metal blade or delamination of the thin layers positioned between the two blade halves. The small bead can be all resin, or resin mixed with small fibers to increase the tensile strength of the bead.

The size of the slot formed between the two walls that form the airfoil is of such size that the blade is rigid enough to operate in the environment, yet flexible enough to allow for the untwisting in the range to provide for high aerodynamic efficiency in the large range of rotational speeds. Modern computer modeling of the blade can easily determine the wall thickness and the size of the slot or free space formed between the airfoil walls or sides that would provide the desired amount of untwist.

We claim the following:

1. A turbomachine blade comprising:

an airfoil portion formed between a blade leading edge and a blade trailing edge, and a pressure side wall and a suction side wall extending between the leading edge and the trailing edge and forming a concave surface on the pressure side and a convex surface on the suction side;

a slot formed within the blade and between the pressure side wall and the suction side wall, the slot extending substantially from the leading edge region to the trailing edge region of the blade, and the slot extending from a blade tip region to a platform region;

the slot being of such thinness that shear stress from one wall to the opposite wall of the airfoil does not transfer in order for the blade twist to increase;

a thin sheet located in the slot and between the adjacent airfoil walls to allow sliding between the airfoil walls and produce a damping effect on the blade during rotation; and, the slot is thin enough such that the adjacent airfoil walls rub during blade rotation and provide damping for the blade.

2. A turbomachine blade comprising:

an airfoil portion formed between a blade leading edge and a blade trailing edge, and a pressure side wall and a suction side wall extending between the leading edge and the trailing edge and forming a concave surface on the pressure side and a convex surface on the suction side;

a slot formed within the blade and between the pressure side wall and the suction side wall, the slot extending substantially from the leading edge region to the trailing edge region of the blade, and the slot extending from a blade tip region to a platform region;

the slot being of such thinness that shear stress from one wall to the opposite wall of the airfoil does not transfer in order for the blade twist to increase.

a thin sheet located in the slot and between the adjacent airfoil walls to allow sliding between the airfoil walls and produce a damping effect on the blade during rotation; and, a thin sheet located in the slot and between the adjacent airfoil walls to allow sliding between the airfoil walls and produce a damping effect on the blade during rotation.

3. The turbomachine blade of claim 2, and further comprising:

the thin sheet fills the space between adjacent airfoil walls.

4. The turbomachine blade of claim 2, and further comprising:

the thin sheet comprises a plurality of thin sheets.

5. The turbomachine blade of claim 2, and further comprising:

a small resin bead on the leading edge and the trailing edge of the thin sheet to prevent crack growth in the blade.

6. The turbomachine blade of claim 1, and further comprising:

the airfoil walls are formed from a fibrous laminated composite material with the fibers arranged such that the blade walls have different stiffness in each direction.

7. The turbomachine blade of claim 6, and further comprising:

the fibers are oriented such that the blade will untwist such that inlet guide vanes can be eliminated directly upstream from the blade.

8. A turbomachine blade comprising:

an airfoil portion formed between a blade leading edge and a blade trailing edge, and a pressure side wall and a suction side wall extending between the leading edge and the trailing edge and forming a concave surface on the pressure side and a convex surface on the suction side;

a slot formed within the blade and between the pressure side wall and the suction side wall, the slot extending substantially from the leading edge region to the trailing edge region of the blade, and the slot extending from a blade tip region to a platform region;

the slot being of such thinness that shear stress from one wall to the opposite wall of the airfoil does not transfer in order for the blade twist to increase;

a thin sheet located in the slot and between the adjacent airfoil walls to allow sliding between the airfoil walls and produce a damping effect on the blade during rotation; and, the thin sheet is formed substantially from Teflon or Kapton or a combination of the two.

9. A turbomachine for compressing a fluid, the turbomachine comprising:

a rotor disk;

a row of compressor blades extending from the rotor disk;

each blade having a thin slit extending between adjacent airfoil walls in which inner surfaces of the adjacent airfoil walls rub to allow for the blades to untwist such that a variable inlet guide vane assembly is not needed for the turbomachine.

10. The turbomachine of claim 9, and further comprising:

the amount of untwist allows for the blades to provide optimal aerodynamics during both a low and a high rotational speed.

11. The turbomachine of claim 9, and further comprising:

the blades are made from fiber laminated composite layers with plies of different stiffness in each direction.

12. The turbomachine of claim 9, and further comprising:

the thin slit allows for the inside adjacent wall surfaces to rub while prevent stress due to centrifugal forces from passing between the adjacent walls.

13. The turbomachine of claim 9, and further comprising:

the thin slit extends from the leading edge to the trailing edge regions of the blade, and from the tip region to the platform region of the blade.

14. A turbomachine for compressing a fluid, the turbomachine comprising:

a rotor disk;

a row of compressor blades extending from the rotor disk;

each blade having a thin slit extending between adjacent airfoil walls to allow for the blades to untwist such that a variable inlet guide vane assembly is not needed for the turbomachine; and, a thin sheet of a slippery material is positioned within the thin slit to promote sliding between the adjacent walls and to promote damping for the blade.

15. The turbomachine of claim 14, and further comprising:

the thin sheet comprises either Teflon or Kapton.

16. The turbomachine of claim 14, and further comprising:

a small resin bead on the leading edge and the trailing edge of the thin sheet in each blade to prevent crack growth in the blade.

* * * * *